US008986787B2

(12) United States Patent
Ritter et al.

(10) Patent No.: US 8,986,787 B2
(45) Date of Patent: Mar. 24, 2015

(54) METHOD FOR APPLYING FORMULATIONS WHICH CONTAIN BACTERIORHODOPSIN ONTO SUBSTRATES, AND PRODUCTS PRODUCED BY THIS METHOD

(75) Inventors: Ulrich Ritter, Nidda-Schwickartshausen (DE); Markus Lange, Bad Dürrenberg (DE); Samuel Schindler, Oehringen (DE)

(73) Assignee: U-NICA Technology AG, Malans (CH)

( * ) Notice: Subject to any disclaimer, the term of this patent is extended or adjusted under 35 U.S.C. 154(b) by 0 days.

(21) Appl. No.: 13/695,877

(22) PCT Filed: Jun. 17, 2011

(86) PCT No.: PCT/EP2011/060163

§ 371 (c)(1),
(2), (4) Date: Nov. 2, 2012

(87) PCT Pub. No.: WO2011/157838

PCT Pub. Date: Dec. 22, 2011

(65) Prior Publication Data

US 2013/0052374 A1 Feb. 28, 2013

(51) Int. Cl.
*B41M 3/14* (2006.01)

(52) U.S. Cl.
CPC ..... *B41M 3/142* (2013.01); *B41M 3/144* (2013.01)
USPC ..... 427/256; 427/265; 427/278; 427/552; 427/557

(58) Field of Classification Search
CPC ..... B41M 3/142; B41M 7/00; B41M 5/142; B42D 15/00
USPC ..... 503/227, 202; 427/256, 265, 278, 552, 427/557
See application file for complete search history.

(56) References Cited

U.S. PATENT DOCUMENTS

| | | | |
|---|---|---|---|
| 5,630,869 | A | 5/1997 | Amon et al. |
| 2005/0206705 | A1 | 9/2005 | Ma et al. |

FOREIGN PATENT DOCUMENTS

| | | | |
|---|---|---|---|
| CH | 701 000 | A1 | 11/2010 |
| DE | 41 05 952 | A1 | 8/1992 |
| DE | 199 14 702 | A1 | 10/2000 |
| EP | 0 327 788 | A2 | 8/1989 |
| EP | 0 406 850 | A1 | 1/1991 |

(Continued)

OTHER PUBLICATIONS

Norbert Hampp et al., "Printing Inks Containing the Photochromic Protein Bacteriorhodopsin", Proc. of SPIE, 2000, pp. 118-125, vol. 3973.

(Continued)

*Primary Examiner* — Bruce H Hess
(74) *Attorney, Agent, or Firm* — Sughrue Mion, PLLC

(57) ABSTRACT

The invention relates to a method for producing a coating, in regions, on a substrate, said coating being based on a formulation, in the form of an active color-change motif, which contains bacteriorhodopsin color-changing pigment, and to coatings produced using a method of this type and to articles having coatings of this type. Here, the method comprises the following steps: a) printing of the substrate with the formulation, in the form of a motif, containing bacteriorhodopsin color-changing pigment; b) partial drying of the printed substrate; c) optionally repetition of steps a) and/or b); calendering of the printed and partially dried substrate; e) complete drying of the coating.

26 Claims, 1 Drawing Sheet

(56) References Cited

FOREIGN PATENT DOCUMENTS

| | | | | | |
|---|---|---|---|---|---|
| EP | 0 487 099 | A2 | | 5/1992 | |
| EP | 0 532 029 | A1 | | 3/1993 | |
| EP | 0 655 162 | A1 | | 5/1995 | |
| EP | 1 171 309 | | | 1/2002 | |
| EP | 1 273 459 | A1 | | 1/2003 | |
| EP | 1 459 301 | | | 9/2004 | |
| EP | 1 577 354 | A2 | | 9/2005 | |
| FR | 2467089 | | * | 4/1981 | ..... B49D 15/02 |
| WO | 94/05008 | A1 | | 3/1994 | |
| WO | 00/59731 | A1 | | 10/2000 | |
| WO | 03/054863 | A2 | | 7/2003 | |
| WO | 2008/092628 | A1 | | 8/2008 | |
| WO | 2010/124908 | A1 | | 11/2010 | |

OTHER PUBLICATIONS

Norbert Hampp et al., "Bacteriorhodopsin-based Multi-level Optical Security Features", Proc. of SPIE-IS&T Electronic Imaging, 2006, pp. 60750M-1-60750M-9, vol. 6075.

International Search Report of PCT/EP2011/060163 dated Aug. 9, 2011.

International Preliminary Report on Patentability for International Application No. PCT/EP2011/060163 dated Jan. 8, 2013.

* cited by examiner

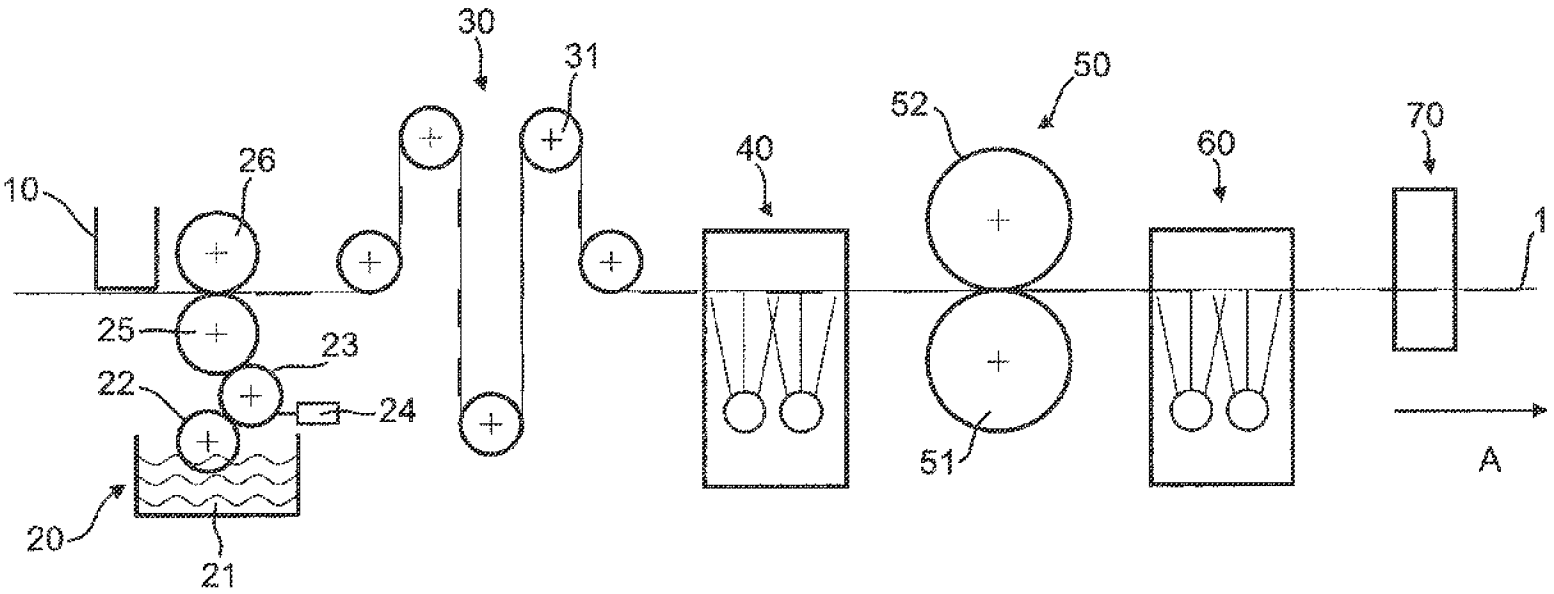
1
A
70
60
50
52
51
40
31
30
26
25
23
24
22
21
20
10

METHOD FOR APPLYING FORMULATIONS WHICH CONTAIN BACTERIORHODOPSIN ONTO SUBSTRATES, AND PRODUCTS PRODUCED BY THIS METHOD

CROSS REFERENCE TO RELATED APPLICATIONS

This application is a National Stage of International Application No. PCT/EP2011/060163 filed Jun. 17, 2011, claiming priority based on Swiss Patent Application No. 00984/10 filed Jun. 18, 2010, the contents of all of which are incorporated herein by reference in their entirety.

TECHNICAL FIELD

The present invention relates to methods for improved application of formulations, which contain bacteriorhodopsin, onto substrates, and to products produced using the method, such as security features and product markings in particular.

PRIOR ART

The light-induced change in colour of the membrane protein bacteriorhodopsin (BR) obtainable from the extremophilic bacterium *Halobacterium salinarum* is well known and has been the subject of a whole series of patents, as described for example in the following documents and background documents cited therein: EP-A-0 406 850; EP-A-0 487 099; EP-A-0 655 162; EP-A-0 532 029; EP-A-1 171 309; EP-A-1 459 301.

However, BR only displays this change in colour in membrane-bound form—reference is made to the purple membrane (PM) in conjunction with BR. In PM-bound form, a change in colour that can be induced by light from violet (in the dark or after "resetting" by means of blue light) to mustard yellow (after exposure to white or green light) is exhibited in a suitable preparation. This change in colour cannot be imitated and can be used to protect against all types of forgery. PM can be wild-type, can be obtained from mutants (single or multiple), or can be PM altered in any other way.

PM is present in the form of cell membrane fragments or particles. The cell membrane fragments are flat pieces measuring a few micrometers in length and width, and measuring 5 nanometers thick. Only intact PM is able to display the desired change in colour. A whole range of substances, particularly low-molecular alcohols, esters, ketones and surfactants, are able to destroy the structure of PM. A change in colour can then no longer be observed.

An alternative method, with which protection against such substances destroying the change in colour is achieved inter alia, is described for example in the Offenlegungsschrift entitled "Method for producing biocompatible hybrimers", WO-A-2008/092628 . This method is advertised under the name "Rhodoglass".

The light-induced change in colour of the PM cannot be imitated. It can be used to protect any objects against forgery. Furthermore, optical data can be written in or read out in two-dimensional applications of PM (ODS or "optical data storage"). For PM data stores, layers of different optical density or thickness are required, depending on the application.

An application of a suitable PM preparation over printing processes is possible. An application in the form of a printable preparation provides the advantage of the possibility of easy integration into existing production lines for applications such as folding boxes, banknotes, ID documents or other objects that are decorated, or produced initially, with a print.

Furthermore, the optically variable colour, that is to say the change in colour from violet to mustard yellow, has a "disturbing effect" in specific applications. This colouring may not be consistent with customer specifications. A partially printed motif is advantageous in that case.

However, previous printable preparations of PM have a range of disadvantages:

- In printed applications corresponding to the prior art, negative to irreversible influences on the PM preparation caused by the conventional printing plant chemicals known to a person skilled in the art have to be anticipated.
- With a print-based solution, the PMs have an irregular distribution in the printed image and a partly speckled, cloudy impression is produced.
- With a print-based solution, particularly with application by screen printing, the surface of the print is not homogeneous and smooth, but is textured and structured in an irregular manner. An unsteady distribution of colour is provided. The screen structure is easily visible with magnification and the "speckled impression" is intensified. The screen structure ("egg box relief"), in combination with an inhomogeneous distribution of the PM within the ink, intensifies the "speckled impression, thus resulting in additional negative optical properties. With screen printing there is also a risk that the screen will become clogged.
- "Unevenesses" in the substrate (many substrates, such as security paper, are uncoated) are not counterbalanced. These unevenesses intensify even further the "unsteady" impression of the printed image.
- Different "height profiles"—from "unevenesses in the material in combination with the screen structure"—are disadvantageous for laser applications. Simplified laser application is only provided with surfaces that are structured in a homogeneous or known manner.
- Further disadvantages of screen printing are as follows:
  - the high screen costs in the case of rotary screen printing;
  - the achievable layer thicknesses are dependent on the screen and are comparatively thick;
  - the thick layers cause drying problems for the printed PM preparation;
  - a number of layers "in succession" (inline) is hardly possible. There are no machines on the market for this purpose. Screen printing is used almost exclusively in the form of a "special colour";
  - sheet-fed applications are predominant in the industry (hardly any web-fed applications).

Rotary screen printing is advantageous, however, in terms of the output rate, the continuity in the printed image and also for combined security solutions comprising other printed effects.

A homogeneous surface with ideal distribution of PM is possible with casting processes. A disadvantage in this instance however is that only applications over entire areas can be implemented. Partial "printing" of a motif is not possible with a casting process.

Cast layers have the advantage of a hardly textured, approximately stochastic distribution of the PM fragments in the layer. This stochastic distribution of the PM is advantageous for applications that contain writing and reading of data (ODS applications).

Furthermore, cast layers have very smooth surfaces. A very uniform "steady" colour impression is obtained.

Very smooth surfaces generally display a shine, however. This surface shine can greatly impair, or prevent, the visibility or perceptibility of a motif.

SUMMARY OF THE INVENTION

The object of the invention, inter alia, is therefore to provide a method for producing, from a printable or transferrable PM preparation having a colour-change functionality, motives printed in one or more layers and having a surface that is smooth or textured in any desired and reproducible manner, at the same time with the greatest possible improvement in protection of the colour-change functionality against harmful environmental influences. The surface, which is smoothed or structured in any desired and reproducible manner, is compressed by the method proposed herein, which affects the surface shine desirably: a smooth surface has a defined shine/glancing angle, a suitably structured surface obtains properties as are known to a person skilled in the art under the term "lenticular structures". Surfaces structured in a suitable and reproducible manner also help to improve inter-layer adhesion in the case of multi-layered structures.

The solution to this problem is achieved in that the method for producing a coating, in regions, on a substrate, in the form of an active colour-change motif, said coating being based on a formulation that contains bacteriorhodopsin colour-change pigment, comprises at least the following steps, normally in the stated order:

a) printing of the substrate with the formulation, containing bacteriorhodopsin colour-change pigment, in the form of a motif,;
b) partial drying of the printed substrate;
c) optionally repetition of steps a) and/or b);
d) calendering of the printed and partially dried substrate;
e) complete drying of the coating.

Step c) is optional, and can be carried out a number of times, for example if a plurality of layers containing the colour-change pigment arranged one above the other are to be produced. It is then possible either to carry out step b) in each case or simply just to carry out step a) a number of times, without specific partial drying. Alternatively or in addition, it is possible to carry out the step of partial drying b) in a number of stages after application of a layer in a step a), that is to say to carry out step b) a number of times.

"Printing" or "printed" means different types of printing processes, as are known to a person skilled in the art. Relief printing, in particular flexographic printing, offset printing and intaglio printing are preferred, wherein, depending on the application, intaglio printing may be less preferable than offset printing due to its solvent basis. Alternatively, screen printing can also be used however.

A surface structured in a predictable and reproducible manner, which has been produced in step d), is able to suppress shine below specific, foreseeable angles for example.

A first preferred embodiment is characterised in that the bacteriorhodopsin colour-change pigment is an optically switchable pigment.

In particular, it is preferably an optionally encapsulated colour-change pigment, as described in application CH 00684/09 , published as CH 701 000 A1 , and in PCT/EP 2010/053673 , published as WO 2010/124908 A1 . The content of these applications with regard to the pigment is incorporated expressly in the disclosure of this document.

In other words, it is preferably a pigment on the basis of microcapsules containing optically switchable bacteriorhodopsin and having a diameter of less than 50 μm, preferably less than 10 μm, and with an encasing layer which protects the bacteriorhodopsin against harmful environmental influences with simultaneous retention of its function. The bacteriorhodopsin is preferably embedded in the form of PM/BR patches in an aqueous medium at a pH value in the range of 6 to 9 in the presence of a water-retaining polymer, and this inner capsule is provided with a casing that is substantially completely permeable to light in the visible range and is formed from a polymer and/or a long-chain saturated hydrocarbon and/or a long-chain saturated fatty acid, preferably a paraffin with a solidification point in the range of 45° C. to 65° C. and/or a carnauba wax with a melting range of 70° C. to 90° C.

The casing layer not only protects against organic solvents and surfactants, but also to a certain extent against the pH value of the surrounding environment. In other words, a defined pH value is present in the microcapsule and remains substantially uninfluenced by the pH value of the surrounding environment of the microcapsule. It can thus be ensured that the microcapsules, or the bacteriorhodopsin/purple membrane system enclosed therein, have the desired optical properties, irrespective of the pH value of the surrounding environment. The microcapsules can also be referred to as pigments or colouring bodies.

Such a colour-change pigment may preferably be produced in a method as described hereinafter, in which, in a first step, bacteriorhodopsin is suspended in the form of bacteriorhodopsin/purple membrane patches in an aqueous medium at a pH value in the range of 6 to 9 in the presence of a water-retaining polymer, and this suspension is spray-dried to a powder or is dried to a powder in an aliphatic solvent at low steam pressure with subsequent solvent removal (for example water removal). In this first step, a precursor capsule is produced to a certain extent, in which the bacteriorhodopsin/purple membrane system is fixed in the pH range suitable for the optical activity thereof. However, this precursor capsule typically does not yet have a sufficiently stable outer skin, said outer skin still being dissolvable in water. The precursor capsule, also referred to as switching powder because this powder already has stabilised optical properties of bacteriorhodopsin, can already be dried, however, and can be stored in a stable manner over relatively long periods of time.

In accordance with a second step, the powder thus obtained is preferably provided with a casing that is substantially completely permeable to light in the visible range and is formed from a polymer (or a precursor thereof, polymer or precursors preferably in dispersion in the process) and/or a long-chain saturated (preferably unbranched) hydrocarbon and/or a long-chain saturated (preferably unbranched) fatty acid (including fatty acid derivatives). In the context of long-chain saturated hydrocarbons and fatty acids, "long-chain" means that (in a mixture on average) at least 15, preferably at least 18 , in particular preferably at least carbon atoms are provided. Examples of long-chain saturated hydrocarbons also include mixtures such as paraffin, preferably with a solidification point in the range of 45° C. to 65° C., and examples of long-chain saturated fatty acids include, for example, esters of aliphatic unbranched C20 to C30 acids with C30 to C34 alcohols (likewise aliphatic and unbranched), such as a carnauba wax (cerotic acid myricyl ester, carnauba acid, cerotic acid and hydrocarbons mixed together), preferably with a melting range of 70° C. to 90° C. The corresponding microcapsule is preferably characterised in that the bacteriorhodopsin is present in the capsule at a pH in the range of 8 to 8.5 and remains substantially completely uninfluenced by the pH value present outside the casing.

The microcapsule is also preferably characterised in that the bacteriorhodopsin is present in the capsule in a buffer system, preferably selected from the following group: phosphate buffer, TRIS/HCl, ammonia buffer, carbonic acid/hydrogen carbonate system, diglycine, bicine, HEPPS, HEPES, HEPBS, TAPS, AMPD or a combination of such systems, preferably in a concentration of less than 0.03 M, in particular preferably in a concentration of less than 0.02 M.

In accordance with a further preferred embodiment, the microcapsules may furthermore be characterised in that the bacteriorhodopsin is present in the capsule in the presence of a humectant, wherein the humectant is preferably a mixture of potassium salt, preferably potash, with a sugar of sugar-alcohol-based humectant, in particular preferably a mixture of potash with xylite and/or sorbitol, most preferably in a ratio of 1:2 to 2:1.

In accordance with a further preferred embodiment, the microcapsule is furthermore characterised in that the bacteriorhodopsin is present in the form of bacteriorhodopsin/purple membrane patches in water-retaining polymer in a proportion of at least 20% by weight, wherein the water-retaining polymer is preferably a system selected from the following group: gelatin, polyethylene glycol, acrylic acid/sodium acrylate copolymer, polyvinylpyrrolidone, polyvinyl alcohol, polysaccharides, gum arabic, derivatised cellulose, glycogen, starch, sugar alcohols, derivatised chitin, xanthan, pectins, guar, locust bean gum, carrageenan, superabsorbents, zeolites and combinations or mixtures of such water-retaining polymers. The polymer of the casing may be selected from the following group: polystyrene, polyacrylate, styrene/acrylate copolymer, polyurethane, polyvinyl alcohol, polyvinyl butyral, modified starch, modified cellulose, or copolymers, mixtures and/or crosslinked or crosslinkable forms thereof.

The microcapsule may comprise one or more encasing layers. The thickness of multi-layered casings around the powder particle should lie in the range of 0.5 to 3%, preferably in the region of 1% of the mean particle diameter.

A further preferred embodiment of the proposed method is characterised in that the coating has a thickness in the range of 0.03 to 300 micrometers, wherein the entire powder particle (the microcapsule) should preferably be no greater than 10 μm.

A plurality of layers can be applied to the substrate, wherein the overall structure formed of a plurality of layers preferably has a total layer thickness in the range of 0.06 to 500 micrometers.

Step a) preferably concerns application in a relief printing method (in particular a flexographic printing method), a lithographic printing method, an intaglio printing method or in a screen printing method, or in a method with use of inkjet-based, dispenser-based, toner-based, or transfer-based technology, the substrate preferably being a cellulose-based and/or plastics-based substrate, in particular a paper substrate, cardboard substrate or a film substrate, or a plastics-based carrier, preferably on the basis of polycarbonate, PVC, PET, ABS, PE and mixtures of these substrates and carriers.

In accordance with the invention, the coating is preferably no longer sticky after step b), that is to say it has substantially no "tack". "Tack" is understood to mean the property of forming a bond of measurable strength with a substrate, with a light contact pressure and after a short contact time.

Methods for measuring tack: The energy, per unit of the interfacial area, that is necessary to separate the bond can be used as a measurement variable for the term "tack", wherein the bond is produced with low contact pressure and within a short contact time (for example 1 s). This separation energy can be measured with defined variation of the most important influencing variables, such as contact pressure, contact time, separation speed and temperature.

The layer to be examined is applied to a carrier plate in a defined thickness and is contacted by means of an electronically controlled motor with a cylindrical plunger made of metal or another material, wherein the contact force and the contact time can be adjusted. At the end of the contact phase, the motor is reversed and the bond between the test plunger and the specimen is separated at a removal speed that is likewise adjustable. With the aid of a force sensor, for example a piezoelectric force sensor, which is connected rigidly to the plunger, the temporal curve of the force over the entire measurement process can be detected. The test plunger and the sample can be housed in a temperature-control chamber, which enables measurements in a relatively large temperature range. Due to an integration of the force-time curve, the adhesive separation energy can be calculated as a measure for tack.

More specifically, this means that the coating preferably has a stickiness or a tack value (separation energy), measured at room temperature using a standardised stainless steel plunger (TA XT plus from stable micro systems), of <10 J/m, in particular of less than 5 J/m.

In addition, the coating is preferably still soft and compressible after step b). More specifically, this means that the coating preferably has an impressibility, determined as microhardness (in accordance with DIN EN ISO 14577 , measured with the aid of the Fischerscope measuring instrument by Fischer with a maximum force of 25.6 mN), of less than 50 $N/mm^2$, preferably of less than 25 $N/mm^2$.

Drying is preferably carried out with the aid of the application of moved hot air, UV application, IR application or electron beam application, in particular preferably with free-radically curing UV coatings under exclusion of oxygen.

Further functional layers without bacteriorhodopsin colour-change pigment can be applied before carrying out step a), between steps c) and d), or after step d), these layers preferably being protective layers, optically absorbing layers, optically reflecting layers, covering layers, retro-reflecting layers or layers coloured with other dyestuffs.

In principle, the motif can be provided in the form of symbols, letters, patterns, raster graphics or combinations of such elements.

The rollers used for step d), applied to both sides of the substrate and pressing said substrate therebetween, preferably have a polished surface, at least on the side facing the coating, for production of a smooth surface of the coating, a polished surface, or a textured surface for the production of a structured surface of the coating, or a combination of polished surface portions with textured surface portions.

A further preferred embodiment of the proposed method is characterised in that the rollers used for step d), applied to both sides of the substrate and pressing said substrate therebetween, have a hard surface, have a soft surface, or have a hard surface on one side of the substrate and a soft surface on the other side of the substrate, wherein a hard roller is preferably a steel, chromium or quartz roller, and a soft roller is preferably a plastics-coated roller, a paper-coated roller or a blanket roller, a neoprene-covered roller or an elastomer-coated roll.

The calendering parameters are preferably selected as follows: hard (chromium or quartz cylinder) or soft (calendering roller corresponding to a blanket roller with silicone or neoprene or corresponding resilient material). A hard roller is preferable for achieving a highly smooth surface, whereas a soft roller is preferable for achieving increased inter-layer adhesion. The roller nip and roll pressure of the calender are defined by the selected binder system of the respective PM preparation. Binders with low shrinkage (such as cationically initiated or free-radically initiated curing epoxy acrylates) require a rather large nip and relatively low roller pressure, whereas binders that shrink to a greater extent (for example water-dilutable, acrylic binders or free-radically initiated pure acrylates) require a rather narrow nip with high roller pressure.

Before step d), the coated substrate may be subjected to a step in which the colour-change pigments are aligned and/or textured.

The formulation containing bacteriorhodopsin colour-change pigment is preferably a formulation on the basis of a water-dilutable acrylic binder system, and/or on the basis of a UV-curable binder, in particular on the basis of a cationically UV-curable binder.

The formulation generally preferably has a viscosity in the range of 0.05 to 100 Pa s. The disclosed viscosity values are based on a temperature of 20° C. The viscosity is preferably adjusted for the respective printing method used, preferably in the range of 0.05 to 0.5 Pa s for flexographic printing, in the range of 40 to 100 Pa s for offset (lithographic) printing, in the range of 0.05 to 0.2 Pa s for intaglio printing, and in the range of 0.5 to 2, preferably in the region of 1 Pa s, for screen printing.

The formulation preferably additionally has a surface tension of less than 40 mN/m.

The colour-change pigment is generally preferably present in the formulation in a proportion by weight in the range of 1 to 67% by weight, in particular preferably in the range of 15 to 32% by weight.

The present invention further relates to a substrate comprising a coating or a plurality of coatings in the form of a motif produced by a method as described above.

The present invention further relates to the use of such a substrate or a coating produced by a method as described above as paper-based and/or film-based decorative and/or security-relevant elements in products, in particular such as passports/identification documents, ID cards, holographically based/holographically associated products, products from the field of "thin films", label-based products, in particular preferably such as visa stickers, product protection and brand protection labels, laminating and transfer foils/films, packaging foils/films, printed documents of value, such as revenue stamps/tax strips, shares, tickets, postage stamps, seals, cards, forms and pre-printed papers as well as combinations of elements of this type.

Such substrates and coatings can be used as optical or non-optical or electronic data stores, preferably such as CDs, DVDs and polymer-based or molecular stores and displays in particular.

Further embodiments are disclosed in the dependent claims.

In general, a printable or transferrable PM preparation with colour-change functionality (as described for example in Swiss application CH 00684/09 , published as CH 701 000 A1 , and in PCT/EP 2010/053673 , published as WO 2010/124908 A1) is thus provided in a quickly surface-dry curing binder, preferably a UV-curable binder, more preferably a cationically initiated UV-curing binder or free-radically initiated UV-curing binder under exclusion of oxygen.

The binding systems are formed in the conventional manner known to a person skilled in the art.

The following list can only be provided by way of example, since fine adjustments (rheology, surface tension, etc.) are often necessary in actual practice so as to adjust the processing properties to the requirements of the respective actual machines and substrates.

Examples of water-dilutable, acrylic binder systems:

Such systems are typically formed of a film former, a dispersant/surfactant, rheology additives (optional) and the actual pigment.

Film formers: quickly drying acrylate dispersion, for example Acronal LR 8820 (BASF) or Joncryl 354 (Johnson polymer) or related types.

Dispersants/surfactants: Selection depending on use and printing method, for example Dynwet (Byk), Disperbyk 168 (Byk), Disperbyk 182 (Byk), Zonyl FSN (DuPont), BRIJ types (Merck), Dispers 650 (Tego) or Dispers 755W (Tego)

Rheology additives: Aerosil types (Degussa-Hüls), Cab-O-sil types (Cabot)

Colouring bodies: μ-powder, as described in application CH 00684/09 and PCT/EP 2010/053673 , further neutral pigments for producing desired decorative effects (for example phthalocyanine PB 15:2)

Examples of UV-curable binders:

Such systems are typically formed of a film former, a reactive thinning agent, a free-radical starter, a surfactant, rheology additives (optional) and the colouring body pigment.

Film formers: Selected, by way of example, from the very large conceivable proposal of UV-crosslinkable film formers (acrylated polyesters, urethanes and epoxy resins): HEMA-TMDI, various manufacturers, or other bisphenol A derivatives Reactive thinning agents: By way of example and not exclusively: HDDA, DPGDA, TPGDA Free-radical starters: A combination of 2-hydroxy-2-methyl-1-phenylpropan-1-one (for example Darucur 1173 (Ciba)) with benzophenone (various manufacturers) and acylphosphinoxide photoinitiators (for example Lucirin TPO (BASF)) has proven to be effective Surfactants: Dynwet types (Byk), Zonyl types (DuPont), BRIJ types (Merck), Surfynol types (AirProducts)

Rheology additives: Aerosil types (Degussa-Hüls), Cab-O-sil types (Cabot)

Colouring bodies: μ-powder, as described in application CH 00684/09 and PCT/EP 2010/053673 , further neutral pigments for producing desired decorative effects (for example phthalocyanine PB 15:2)

Examples of a cationically UV-curable binder:

Such systems are typically formed of a film former, a starter combination, a surfactant, rheology additives (optional) and the colouring body pigment.

Film formers: bis-vinyl ether monomers or cycloaliphatic epoxides in combination with reactive acrylates, such as HEMA-TMDI or other bisphenol A derivatives Starter combinations: the combination of a cationic starter with free-radically acting starters is known to a person skilled in the art. The selection of cationic starters is rather limited and dependent on each individual case (substrate, machine, used radiation emitters). Cationic starters fall within one of the three following substance classes: diaryl iodonium salts, triaryl sulfonium salts or ferrocenium salts, wherein ferrocenium salts are less preferred in the present application.

Surfactants: Dynwet types (Byk), Zonyl types (DuPont), BRIJ types (Merck), Surfynol types (AirProducts)

Rheology additives: Aerosil types (Degussa-Hüls), Cab-O-sil types (Cabot)

Colouring bodies: μ-powder, as described in application CH 00684/09 and PCT/EP 2010/053673 , further neutral pigments for producing desired decorative effects (for example phthalocyanine PB 15:2)

The finished PM preparation lies in a viscosity range of approximately 1 Pa s (set for screen printing) at RT and with a shear rate of 30 l/s. The surface tension of the finished PM preparation is less than 40 mN/m, preferably less than 35 mN/m.

The printable or transferrable PM preparation contains PM in different concentrations (specific to the application) between 1% and 67%, preferably between 15% and 32%.

The opacity of the layers is adjusted between semi-permeable and completely impermeable by suitable additives, as are known to a person skilled in the art and as are conventional in graphic chemistry.

The PM preparation is applied to film or paper substrate by means of any desired motif in a printing process, preferably in a printing process with layer thicknesses of approximately more than 10 μm, such as relief printing (preferably flexographic printing), but also lithographic-based, intaglio-based, screen-printing-based printing methods and further application techniques, such as inkjet-based, dispenser-based, toner-based and transfer-based technology and also hot-melt methods. The printed PM preparation is then subjected to partial drying or partial curing in a first step, such that the surface is no longer sticky.

This can be implemented with a conventional solvent-based or water-based PM preparation by moved hot air or sufficiently short IR drying. With a cationically initiated UV-curable PM preparation, the partial curing is achieved by irradiation with sufficiently low UV dose rates, which are still too low to lead to complete, through curing of the layer (the process should not be interrupted in the case of cationic curing, since dark curing leads to complete, through curing after a certain period of time, stop times can be critical accordingly). With a free-radically initiated UV-curable PM preparation, the surface-dry partial curing is achieved by irradiation with sufficiently low UV dose rates under exclusion of oxygen. Furthermore, electron beam curing is also possible. With electron beam curing, curing is initially carried out analogously with a dose rate that only leads to curing of the surface, and not to complete, through curing however. Free-radically initiated UV curing under exclusion of oxygen or cationically initiated UV curing as well as electron beam curing are known to a person skilled in the art.

It may also be expedient or necessary to cool the coated substrate to suppress surface stickiness.

With regard to process monitoring, it is recommended to monitor pull-off angle or tack at this point of the process. Since the processability of the partially cured/partially dried surface depends on the type of machine used, in particular on the type of anti-adhesion coating of the deflecting rollers, which contact the layer, it is impossible to give an absolute value in this case. To provide a first estimation, a finger-pressure test is sufficient: with contact and then detachment again of the surface, said surface may no longer feel noticeably sticky. Based on the protocols stated above for determining stickiness, it is preferable if the stickiness is set in the range of <10 J/m, in particular of less than 5 J/m, and with regard to the above-cited impressibility, this is preferably set to less than 50 N/mm$^2$, preferably to less than 25 N/mm$^2$.

The PM preparations preferably dry within a few seconds, optionally assisted by moved hot air in the case of a water-dilutable, acrylic binder. In the case of a free-radically UV-curable preparation, curing is quick enough in all practical instances, provided measures are taken to exclude ambient oxygen in a suitable manner known to a person skilled in the art. In the case of a cationically UV-curable preparation, curing of the surface can, in all cases, be carried out so quickly that the process can be carried out quickly.

With a multi-layered structure, one or more intermediate curing steps may be necessary.

The motif on the basis of a PM preparation is applied to the substrate in at least one layer, depending on its proton availability and/or pH value, and in up to 24 layers depending on the application. In this case, the individual layer thicknesses vary between 0.03 and 256 micrometers depending on the respective printing method.

Further, non-PM-based separation layers or functional layers (with identical or different colour base) can be incorporated between the PM preparation, either over the entire area or merely over part of the area and also in a structured manner; furthermore, these layers may also be arranged beneath or above and may have a protective, blocking, absorbing, reflective or retro-reflecting or covering nature.

In some applications, transparent, semi-transparent and/or chromophoric properties are required above or below the layer containing the PM preparation and may vary in their opacity. The layers can be pigmented or doped in another manner depending on the application and the product.

It is likewise possible, and possibly preferred, to carry out a texturizing step and/or orientation step for the PM pigments contained in the applied formulation, before the calendering step described hereinafter or else, with application of a plurality of layers before calendering, either before of after one or more partial drying steps. Such a texturizing step and/or orientation step may consist, for example, in guiding the printed and partially dried web or sheet around rollers in a serpentine-like manner, which results in the PM fragments, which are otherwise oriented randomly in the layer, being aligned substantially parallel to the substrate surface, which has a positive effect inter alia on the optical properties. For example, it is possible to guide the horizontally fed web upwardly around a roller, then vertically downward around a deflecting roller, again vertically upward around a further deflecting roller, and so on, and to then deflect it again into the horizontal direction after having been guided upwardly 2 to 4 times and downwardly 2 to 4 times for example.

Normally, as a penultimate method step, the printed substrate that is decorated with one or more layers of partially cured PM preparation, but is still soft, is calendered, that is to say is exposed to a high compressive force applied by a smooth roller or by a roller provided with a suitably selected surface, such that the printed layer of the PM preparation is compressed and the surface of the motives adopts the structure (smooth or grooved) of the surface of the calendering roller.

The roller of the calender may be hard (chromium or quartz cylinder) or soft (calendering roller corresponding to a blanket roller with silicone or neoprene or corresponding resilient material), depending on the desired application. A hard roller is preferred to achieve a highly smooth surface, whereas a soft roller is preferred to achieve increased inter-layer adhesion.

The roller nip and roll pressure of the calender are defined by the selected binder system of the respective PM preparation. Binders with low shrinkage (such as cationic or free-radical epoxy acrylates) require a larger nip and relatively low roll pressure, whereas binders that shrink to a greater extent (for example water-dilutable, acrylic binders or free-radically initiated pure acrylates) require a narrower nip with high roll pressure. Roll pressures preferably lie in the range of 30 to 300 N/mm, in particular of 100 to 180 or 120 to 150 N/mm.

The structuring of the surface by calendering is then typically followed directly by complete, thorough drying in the case of solvent-based or aqueous PM preparations, or by complete through curing in the case of UV-curable or electron beam curable preparations.

In accordance with the above-described method, film substrates or paper substrates can be decorated by means of established printing methods with any desired motives containing a PM preparation having colour-change functionality, and the surface of the printed colour-changing motives can be provided, in the subsequent calendaring step, either in a smooth manner or with a shine-suppressing diffractive layer.

The PM preparation compressed by the calendering step offers a higher degree of protection against harmful environmental influences.

Fields of application of the method include paper-based and/or film-based decorative and security-relevant elements in products, such as passports/identification documents, ID cards, holographically based/holographically associated products, products from the field of "thin films", label-based products (such as visa stickers, product protection and brand protection labels), laminating and transfer foils/films, packaging foils/films, printed documents of value, such as revenue stamps/tax strips, shares, tickets, postage stamps, seals, cards, forms and pre-printed papers, etc., and applications to plastics-based carriers, such as polycarbonate, PVC, PET, ABS, PE, etc. and mixtures thereof.

Further fields of application lie in the field of optical, non-optical or electronic data stores, such as CDs, DVDs and polymer-based or molecular stores and displays in particular.

Applications also lie in the fields of security, medicine, pharmaceutics, biology, chemistry, luxury and consumer goods, image processing, electronics, optics, etc.

To summarise, a new method is thus proposed herein, with which printed layers of a PM preparation can be applied and improved in terms of quality.

The objective is to optimise regions printed with PM preparation, in such a way that these regions can be used for various purposes and applications in the field of optical data storage and/or supplementary security elements.

In this instance, the application of layers formed of PM preparation is based on printing methods, such as relief printing (preferably flexographic printing), but also lithographic-based, intaglio-based, screen-printing-based printing methods as well as further application techniques, such as inkjet-based, dispenser-based, toner-based and transfer-based technology and also hot-melt methods.

Application is ideally implemented over an entire area, but may also be implemented over a partial area, in the form of image-based motives and varying designs and/or text areas.

The binder is either "conventional", that is to say solvent-based or water-based, or UV-curable or electron beam curable.

If the layer formed of PM preparation is free-radically cured, the curing process should preferably be carried out in an oxygen-minimised environment, for example under nitrogen, argon and/or $CO_2$ atmosphere.

The layers containing PM preparation are subjected to curing/drying promptly (that is to say "inline", without an interruption to the process) after application; this may also be preliminary partial drying or partial curing (drying or curing depending on the binder). The extent of the curing/drying can vary from layer to layer.

A key aspect of the method is the subsequent single or multiple compression of the individual layers, or of some or all thereof, by means of hard or soft roll(s), roller(s) or cylinders (calendering step) after the first curing/drying. In this case, the layers containing the PM preparation and/or the functional layers or separation layers may be provided with a smoothed surface and/or with structures (nano-structures or micro-structures), for example for improved mutual adhesion or to suppress shine or to provide other, decorative effects. These structures are directed or undirected over the entire area or partial area(s) and/or have variations in the horizontal or vertical angles.

Depending on the application, the surface curing or through curing of the respective layers is carried out either after each layer or on the structure as a whole by means of one or more curing/drying steps. Drying is carried out in accordance with the binder (see above) and may possibly also be applied in a shielded/separate manner in combination and in a number or separate application steps.

In many applications, cooling systems for stabilising/optimising quality are expedient or necessary in addition to the aforementioned drying methods.

The PM preparation can be applied on stand-alone machines, custom machines and/or in existing facilities (such as application and/or printing machines) and also by means of a slide-in module.

BRIEF DESCRIPTION OF THE DRAWINGS

The one FIGURE shows a schematic illustration of a preferred exemplary embodiment of a device for carrying out the method according to the invention.

DESCRIPTION OF PREFERRED EMBODIMENTS

Preferred embodiments of the invention will be described hereinafter; they are intended merely to explain the invention and are not to be considered as limiting.

EXAMPLE 1

Application By Screen Printing

A PM preparation that is free-radically UV-curable, under exclusion of oxygen, is listed by way of example (PBW: parts by weight):

| | | |
|---|---|---|
| Film former: | HEMA-TMDI | 77.20 PBW |
| Reactive thinning agent: TPGDA | 8.90 PBW | |
| Radical starters: | 2-hydroxy-2-methyl-1-phenylpropan-1-one | 1.75 PBW |
| Benzophenone | | 0.45 PBW |
| Acylphosphinoxide photoinitiator | | 0.10 PBW |
| Surfactant: | ethoxylated non-ionic fluorine surfactant | 0.05 PBW |
| Rheology additives: | pyrogenic silicic acid | 0.10 PBW |
| Colouring body: | Solvent Red 118 | 0.05 PBW |
| μ-powder | acc. to CH 00684/09 and PCT/EP 2010/053673 | 11.40 PBW |

With use of this formulation, a motif was applied onto a paper substrate in a screen printing method in a thickness of 6 to 12 micrometers.

This coating was then exposed to UV radiation for a period lasting a few tenths of a second, and the substrate was then calendered between two polished steel rolls at a roll pressure of 100 Nm at room temperature.

The calendered coating was then again subjected to UV radiation for 0.5 to a few seconds and was then dried and cured.

The resultant motif coating was extremely resistant to mechanical loads and adhered well to the substrate. It displayed reliably light-induced colour-change behaviour and had a homogeneous colour impression and homogeneous shine.

In a second experiment a multi-layered structure was applied by the same method, wherein intermediate drying was carried out with use of UV radiation after each printing method. Different types of colour-change pigment powder were used in different layers so as to achieve a colour effect dependent on the layer.

EXAMPLE 2

Application By Flexographic Printing

The following PM preparation was used for flexographic printing:

| | | |
|---|---|---|
| Film former: | HEMA-TMDI | 77.20 PBW |
| Reactive thinning agent: | TPGDA | 8.90 PBW |
| Radical starters: | 2-hydroxy-2-methyl-1-phenylpropan-1-one | 1.75 PBW |
| Benzophenone | | 0.45 PBW |
| Acylphosphinoxide photoinitiator | | 0.10 PBW |
| Surfactant: | ethoxylated non-ionic fluorine surfactant | 0.10 PBW |
| Rheology additives: | pyrogenic silicic acid | 0.05 PBW |
| Colouring body: | Solvent Red 118 | 0.05 PBW |
| μ-powder | acc. to CH 00684/09 and PCT/EP 2010/053673 | 11.40 PBW |

This resulted in an ink of lower viscosity compared to that for the screen printing according to Example 1.

With use of this formulation, a motif was applied onto a paper substrate in a flexographic printing method with a surface application weight of approximately 2 g/m$^2$.

This coating was then exposed to UV radiation for a period lasting a few tenths of a second, and the substrate was then calendered between two polished steel rolls at a roll pressure of 100 Nm at room temperature.

The calendered coating was then again subjected to UV radiation for 0.5 to a few seconds and was then dried and cured.

The resultant motif coating was again extremely resistant to mechanical loads and adhered well to the substrate. It displayed reliably light-induced colour-change behaviour and had a homogeneous colour impression and homogeneous shine. The quality obtained was greater, on the whole, compared to Example 1.

Small amounts, for example 0.20 to 0.50 PBW of an inorganic solvent can optionally be added both in Example 1 and in Example 2 so as to increase the steam pressure and thus eliminate oxygen. Suitable solvents include terpenes in particular. Acetone can also be used, in particular if the BR preparation is present in encapsulated form, as in the present examples.

EXAMPLE 3

Device For Carrying Out the Method

FIG. 1 illustrates a very schematic form of a possible device for carrying out a method according to the invention. A substrate web 1 made of paper passes through the device in the direction A. It first passes through an antistatic unit 10 to reduce electrostatic charges. Motives formed from a PM preparation are applied onto the substrate web 1 in an application unit 20 for flexographic printing (in this case comprising a colour bath 21, an immersed roller 22, an anilox roller 23, a doctor blade 24, plate cylinder 25 and impression cylinder 26 by way of example). The substrate web 1 is deflected a number of times by a number of rolls 31 in an alignment tunnel 30 and is stretched slightly during the process, whereby the colour-change pigments in the motives are aligned. The substrate with the motives is then partially dried in a UV intermediate dryer 40, such that it is then still sticky. The substrate is then calendered between calendering cylinders 51, 51. This process not only includes pressing, but also defined smoothing, curing and drying, wherein the set roll pressure, the hardness and type of the cylinder material and the temperature of the cylinders play a role. The calender may also have a plurality of cylinders and impression cylinders, of which the materials may be different. Lastly, the substrate is dried in a UV end dryer 60 and is cooled in a cooler 70. The printed substrate is then absolutely dry and no longer sticky.

Instead of an application device for flexographic printing, other application devices for other printing methods can also be used. An additional impression step may optionally be provided before the calendering process so as to additionally texturize the pigments. Instead of just a single application unit 20 and a single intermediate dryer 40, a plurality of application units and intermediate dryers can be arranged in succession so as to apply further layers onto the substrate before the printed substrate is calendered. In this instance merely partial drying is implemented in each case. Final drying may also be carried out in part or completely in the calender, wherein a quartz roller with a UV source for example is used as a calendering cylinder on the side of the substrate onto which the printed layers are applied.

The invention claimed is:

1. A method for producing a coating, in regions, on a substrate, said coating being applied in the form of an active colour-change motif, said coating being based on a formulation that contains bacteriorhodopsin colour-change pigment, said method comprising the following steps:

a) printing of the substrate with the formulation, which contains bacteriorhodopsin colour-change pigment, in the form of a motif;

b) partial drying of the printed substrate such that the coating is no longer sticky, but still soft and compressible;

c) optionally repeating steps a), b), or both a) and b);

d) calendering of the printed and partially dried substrate;

e) complete drying of the coating.

2. The method according to claim 1, wherein the bacteriorhodopsin colour-change pigment is an optically switchable pigment.

3. The method according to claim 1, wherein the coating has a thickness in the range of 0.03 to 300 micrometers.

4. The method according to claim 1, wherein printing in step a) is carried out by one of a relief printing method, a lithographic printing method, an intaglio printing method, a screen printing method, and a method with use of inkjet-based, dispenser-based, toner-based, or transfer-based technology.

5. The method according to claim 1, wherein at least one further functional layer without bacteriorhodopsin colour-change pigment is applied before carrying out step a), between steps c) and d), or after step d).

6. The method according to claim 5, wherein the further functional layer is one of a protective layer, an optically absorbing layer, an optically reflecting layer, a covering layer, a retro-reflecting layer, and a layer coloured with other dyestuffs.

7. The method according to claim 1, wherein the motif is provided in the form of symbols, letters, patterns, raster graphics, or combinations of such elements.

8. The method according to claim 1, wherein in step d), rollers are applied to both sides of the substrate and press said substrate therebetween, at least one of the rollers having a polished surface, arranged at least on the side facing the coating, for production of a smooth surface of the coating, or at least one of the rollers having a textured surface for the production of a structured surface of the coating, or at least one of the rollers having a combination of polished surface portions with textured surface portions.

9. The method according to claim 1, wherein in step d), rollers are applied to both sides of the substrate and press said substrate therebetween, wherein the rollers have a hard surface, the rollers have a soft surface, or one of the rollers, arranged on one side of the substrate, has a hard surface, while another one of the rollers, arranged on the other side of the substrate, has a soft surface.

10. The method according to claim 9, wherein at least one of said rollers has a hard surface made of steel, chromium, or quartz.

11. The method according to claim 9, wherein at least one of said rollers is a plastics-coated roller, a blanket roller, a neoprene-covered roller, or an elastomer-coated roller.

12. The method according to claim 1, wherein, before step d), the coated substrate is subjected to a step in which the colour-change pigments are aligned, textured or both aligned and textured.

13. The method according to claim 1, wherein the formulation containing bacteriorhodopsin colour-change pigment is a formulation on the basis of a water-dilutable acrylic binder system, on the basis of a UV-curable binder, or on the basis of both a water-dilutable acrylic binder system and a UV-curable binder.

14. The method according to claim 1, wherein the bacteriorhodopsin colour-change pigment is a pigment on the basis of microcapsules containing optically switchable bacteriorhodopsin and having a diameter of less than 50 pm, the microcapsules having an encasing layer which protects the bacteriorhodopsin against harmful environmental influences with simultaneous retention of its function.

15. The method according to claim 1, wherein the coating has a thickness in the range of 10 to 300 micrometers.

16. The method according to claim 1, wherein the substrate is a cellulose-based, plastics-based substrate or both cellulose-based and plastics-based substrate.

17. The method according to claim 1, wherein the coating, after step b), has a tack value of less than 10 J/m.

18. The method according to claim 1, wherein the coating, after step b), has an impressibility of less than 50 N/mm2.

19. The method according to claim 1, wherein drying in at least one of steps b) and e) is carried out with the aid of the application of moved hot air, UV application, IR application, or electron beam application.

20. The method according to claim 1, wherein drying in at least one of steps b) and e) is carried out under exclusion of oxygen.

21. The method according to claim 1, wherein the formulation containing bacteriorhodopsin colour-change pigment is a formulation on the basis of a cationically UV-curable binder.

22. The method according to claim 1, wherein the formulation containing bacteriorhodopsin colour-change pigment has a viscosity in the range of 0.05 to 100 Pa s.

23. The method according to claim 1, wherein the formulation containing bacteriorhodopsin colour-change pigment has a viscosity in the range of 0.05 to 0.5 Pa s if printing in step a) is carried out by flexographic printing, in the range of 40 to 100 Pa s if printing in step a) is carried out by offset printing, in the range of 0.05 to 0.2 Pa s if printing in step a) is carried out by intaglio printing, and in the region of 1 Pa s if printing in step a) is carried out by screen printing.

24. The method according to claim 1, wherein the formulation containing bacteriorhodopsin colour-change pigment has a surface tension of less than 40 mN/m.

25. The method according to claim 1, wherein the bacteriorhodopsin colour-change pigment is present in the formulation in a proportion by weight in the range of 1 to 67% by weight.

26. The method according to claim 1, wherein the bacteriorhodopsin colour-change pigment is present in the formulation in a proportion by weight in the range of 15 to 32% by weight.

* * * * *